United States Patent [19]

Ruskin

[11] 4,202,412

[45] May 13, 1980

[54] THERMALLY METAMORPHOSING OIL SHALE TO INHIBIT LEACHING

[75] Inventor: Arnold M. Ruskin, Claremont, Calif.

[73] Assignee: Occidental Oil Shale, Inc., Grand Junction, Colo.

[21] Appl. No.: 920,237

[22] Filed: Jun. 29, 1978

[51] Int. Cl.[2] ..... E21B 43/24; E21C 41/10

[52] U.S. Cl. ..... 166/256; 166/259; 166/263; 166/272; 299/2

[58] Field of Search ..... 166/256, 259, 263, 272, 166/303; 299/2

[56] References Cited

U.S. PATENT DOCUMENTS

| | | | |
|---|---|---|---|
| 3,111,986 | 11/1963 | Kuhn, Jr. | 166/256 |
| 3,292,699 | 12/1966 | Slusser et al. | 166/256 X |
| 3,454,958 | 7/1969 | Parker | 166/256 |
| 3,586,377 | 6/1971 | Ellington | 299/2 X |
| 3,630,278 | 12/1971 | Parker | 166/259 |
| 4,057,293 | 11/1977 | Garrett | 299/2 |
| 4,126,180 | 11/1978 | Cha | 166/259 X |

*Primary Examiner*—Stephen J. Novosad
*Assistant Examiner*—George A. Suchfield
*Attorney, Agent, or Firm*—Christie, Parker & Hale

[57] ABSTRACT

When processing a fragmented permeable mass of particles containing oil shale for recovering liquid and gaseous values, a portion of the oil shale is thermally metamorphosed. However, a zone of non-thermally metamorphosed particles can be left in the fragmented mass after completion of processing. To inhibit leaching by water of water-soluble constituents of such non-thermally metamorphosed particles, a heating fluid, such as a mixture of fuel and an oxygen-containing gas, is introduced to the fragmented mass containing non-thermally metamorphosed particles for heating at least a portion of the non-metamorphosed particles to a sufficiently high temperature for forming water-insoluble metamorphic minerals at at least the surfaces of such particles.

33 Claims, 4 Drawing Figures

THERMALLY METAMORPHOSING OIL SHALE TO INHIBIT LEACHING

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale", as used in the industry, is in fact a misnomer; it is neither shale, nor does it contain oil. It is a sedimentary formation comprising marlstone deposit and including compounds containing alkaline earth metals and compounds containing silica. Oil shale includes layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone at the top of the fragmented mass and introduction of an oxygen-containing retort inlet mixture into the retort as an oxygen-containing gaseous combustion zone feed to advance the combustion zone downwardly through the retort. In the combustion zone, oxygen of the combustion zone feed is depleted by reaction with hot carbonaceous materials to produce heat, combustion gas, and combusted oil shale. Temperatures are attained in the combustion zone sufficiently high to decompose carbonates of alkaline earth metals in oil shale to the corresponding oxides of alkaline earth metals and sufficiently high to thermally metamorphose constituents of the fragmented mass. By the continued introduction of the retort inlet mixture into the retort, the combustion zone is advanced downwardly through the fragmented mass in the retort.

The combustion gas and any gaseous portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by cooler oil shale fragments in the retort on the advancing side of the retorting zone. The liquid hydrocarbon products, together with water produced in or added to the retort, are withdrawn from the fragmented mass at the bottom of the retort. An off gas containing combustion gas, gaseous products produced in the retorting zone, carbon dioxide from carbonate decomposition, and any gaseous retort inlet mixture that does not take part in the combustion process, is also withdrawn from the fragmented mass at the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature it reacts with oxygen, thereby causing the combustion zone to advance through the fragmented oil shale.

As the combustion and retorting zones advance to the bottom of the fragmented mass, the temperature of the off gas increases. Retorting is stopped before the combustion zone reaches the bottom of the fragmented mass to prevent the temperature of the off gas from becoming so high that off gas collection processing equipment is damaged. Therefore, at the end of retorting, a retort can contain a substantial quantity of oil shale at the bottom of the fragmented mass which has not attained a sufficiently high temperature for thermal metamorphosis of the oil shale. This non-thermally metamorphosed oil shale can contain water-soluble constituents. Concern has been expressed that these water-soluble constituents can be leached by ground water, thereby contaminating ground water. A high level of contaminants in ground water can make it unsuitable for some uses, including domestic uses.

SUMMARY

According to the present invention, a method is provided for inhibiting leaching of water-soluble constituents from non-metamorphosed particles containing oil shale in a fragmented permeable mass containing oil shale. Such non-metamorphosed particles are left in an in situ oil shale retort by advancing a processing zone, such as a combustion zone, only part way through the fragmented mass. The processing zone is advanced through the fragmented mass by introducing a retort inlet mixture to the fragmented mass on the trailing side of the processing zone. Before the processing zone reaches the end of the fragmented mass, introduction of the retort inlet mixture to the fragmented mass is stopped, thereby leaving at least a portion of the fragmented mass containing non-metamorphosed particles on the advancing side of the processing zone.

To inhibit leaching of water-soluble constituents from such non-metamorphosed particles, sufficient heating fluid is introduced to the fragmented mass containing non-metamorphosed particles for heating at least a portion of such non -metamorphosed particles to a sufficiently high temperature for forming water-insoluble metamorphic minerals.

DRAWINGS

These and other features, aspects, and advantages of the present invention will become more apparent with respect to the following description, appended claims, and accompanying drawings, wherein:

FIG. 1 schematically represents in vertical cross-section an in situ oil shale retort containing non-metamorphosed particles, the particles being treated to inhibit leaching of water-soluble constituents therefrom;

DESCRIPTION

Figure 1:
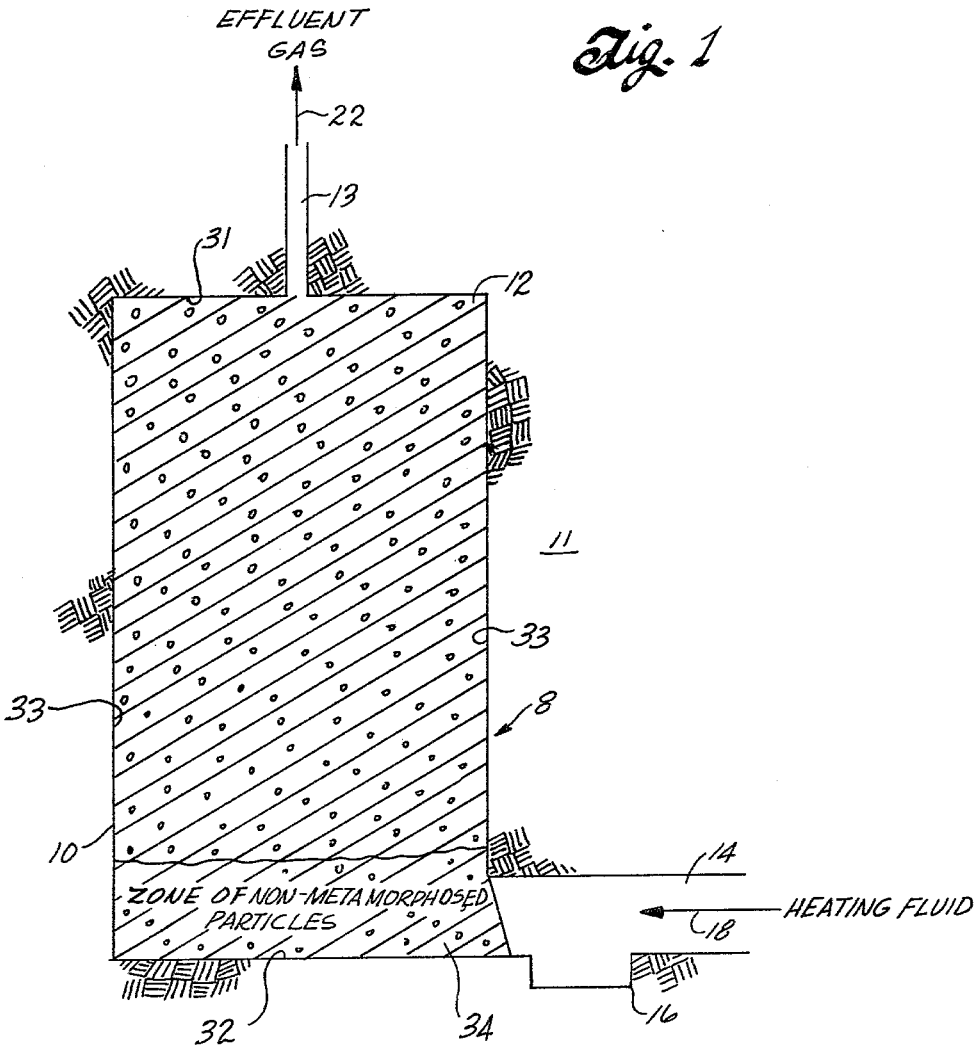

Referring to FIG. 1, in an embodiment of this invention an already-retorted in situ oil shale retort 8 is in the form of a cavity 10 formed in an unfragmented subterranean formation 11 containing oil shale. The cavity contains an expanded and fragmented permeable mass 12 of formation particles and has opposed top 31 and bottom 32 boundaries of unfragmented formation and also has opposed side boundaries 33 of unfragmented formation. The cavity 10 can be created simultaneously with fragmentation of the mass of formation particles 12 by blasting by any of a variety of techniques. Methods for forming an in situ oil retort are described in the aforementioned U.S. Pat. Nos. 3,661,423; 4,043,595; 4,043,596; 4,043,597; and 4,043,598.

One or more conduits 13 communicate with the top of the fragmented mass of formation particles. During the retorting operation of the retort 8, a processing zone is established in an upper portion of the fragmented mass and advanced downwardly by introducing a retort inlet mixture into the in situ oil shale retort through the conduits 13. The processing zone can be a combustion zone or a retorting zone. Both a combustion zone and a retorting zone can be established in a retort.

When a combustion zone is to be advanced through the fragmented mass, the retort inlet mixture contains an oxygen-containing gas, such as air or air mixed with other gases. As the oxygen-containing retort inlet mixture is introduced to the retort as a combustion zone feed, oxygen oxidizes carbonaceous material in the oil shale to produce combusted oil shale and combustion gas. Heat from the exothermic oxidation reactions carried by flowing gases advances the combustion zone downwardly through the fragmented mass of particles.

As used herein, the term "oxygen-containing gas" refers to oxygen; air; air enriched with oxygen; air mixed with a diluent such as nitrogen, off gas from an in situ oil shale retort, or steam; and mixtures thereof.

When only a retorting zone is advanced through the fragmented mass, the retort inlet mixture contains insufficient oxygen to oxidize carbonaceous material in the oil shale. It can be a hot inert gas, such as hot nitrogen, or a mixture of fuel and only sufficient oxygen for oxidizing the fuel.

Combustion gas produced in the combustion zone, any gaseous unreacted portion of the combustion zone feed, and gases from carbonate decomposition are passed through the fragmented mass of particles on the advancing side of the combustion zone to establish a retorting zone on the advancing side of the combustion zone. Kerogen in the oil shale is retorted in the retorting zone to yield retorted oil shale; gaseous products, including hydrocarbons; and shale oil.

There is a drift 14, or the like, in communication with the bottom of the retort. The drift contains a sump 16 in which liquid products are collected to be withdrawn for further processing. An off gas containing gaseous products, combustion gas, gases from carbonate decomposition, and any gaseous unreacted portion of the combustion zone feed is also withdrawn from the in situ oil shale retort 8 by way of the drift 14.

At the end of retorting operations, at least part of the oil shale in the retort 8 is at an elevated temperature, which can be in excess of about 1000° F. The hottest region of the retort is often near the bottom, and a somewhat cooler region is at the top, due to continual cooling by inlet gas during retorting and conduction of heat to adjacent shale. The oil shale in the retort 8 gradually cools toward ambient temperature when retorting and combustion are complete.

The retort illustrated in FIG. 1 has had retorting and combustion operations completed. A portion of the particles in the fragmented mass have been thermally metamorphosed due to passage of the retorting and combustion zones. Insolubilization of water-soluble constituents of oil shale results from this thermal metamorphosis, particularly if temperatures in excess of about 1400° F. are attained in the fragmented mass. However, at least a portion 34 of the fragmented mass on the advancing side of the combustion zone contains non-metamorphosed particles, because introduction of the retort inlet mixture to the fragmented mass is stopped before the combustion zone reaches the bottom of the fragmented mass for stopping downward advancement of the combustion zone. This is done to prevent the temperature of the off gas from becoming so high that off gas collection and processing equipment are damaged. There can be non-metamorphosed particles elsewhere in the retort, such as along the side boundaries of the retort.

As used herein the term "thermally metamorphosed particles" refers to oil shale particles heated to sufficient temperature, generally at least about 1400° F., so that water-insoluble metamorphic minerals have formed. The term "non-metamorphosed particles" refers to particles containing oil shale which have not been heated to a sufficient temperature that water-insoluble metamorphic minerals have formed. Excluded from the definition of thermally metamorphosed particles, and included in the definition of non-metamorphosed particles, are particles which have been heated to a temperature such that thermal metamorphosis not resulting in formation of water-insoluble metamorphic minerals occurs. For example, a particle of oil shale heated to a sufficiently high temperature that calcium carbonate decomposes to form calcium oxide, but not to 1400° F., is considered to oe a "non-metamorphosed particle".

Oil shale contains large quantities of carbonates of alkaline earth metals, principally carbonates of calcium and magnesium, which, during retorting and combustion, may be at least partly calcined to produce corresponding oxides of the alkaline earth metal. For example, oil shale particles in the retort 8 before retorting can contain approximately 8 to 12 weight percent calcium and 1.5 to 3 weight percent magnesium present as carbonates.

Magnesium and calcium carbonate can be present initially in the formation in a variety of mineral forms of varying compositions, such as magnesite, brucite, dolomite, ferroan, and ankerite. In stoichiometric dolomite, there is one magnesium atom per calcium atom. Calcium-rich dolomites, having ratios of magnesium to calcium of less than one, can also occur. The aforementioned mineral forms and others, including illite, dawsonite, analcime, aragonite, calcite quartz, potassium feldspar, sodium feldspar, nahcolite, siderite, pyrite, and fluorite, have been identified in oil shale by x-ray diffraction analysis. The presence of such mineral forms in oil shale has been reported in W. Robb et al, "Mineral Profile of Oil Shales in Colorado Core Hole No. 1, Piceance Creek Basin, Colorado", *Energy Resources of the Piceance Creek Basin, Colorado;* D. Keith Murray, Ed., Rocky Mountain Association of Geologists, Denver, Colorado, pages 91–100 (1974); and E. Cook, "Thermal Analysis of Oil Shales", *Quarterly of the Colorado School of Mines,* Vol. 65, pages 133–140 (1970).

The Cook article states that dolomite in oil shale in the Green River formation, which includes the Piceance Creek Basin, is actually in the form of ankerite and, therefore, has a lower decomposition temperature than pure iron-free dolomite. The minerals in oil shale are present in very fine crystals in various intimate admixtures and can interact during retorting and combustion. Thus, minerals such as dolomite in oil shale are not expected to behave the same as more pure forms of the mineral. In addition, as stated in the Cook article, it is difficult to predict the temperature range or the extent of carbonate decomposition during retorting of oil shale, because carbonate decompositions are dependent in part on the partial pressure of carbon dioxide in the retort atmosphere.

There can be a substantial amount of ground water in subterranean formations containing oil shale. Concern has been expressed that this ground water can become contaminated by leaching of water-soluble constituents, such as oxides of alkaline earth metals and compounds containing sodium and potassium, from oil shale.

Therefore, according to the present invention, to inhibit leaching of water-soluble constituents from non-metamorphosed particles containing oil shale, a heating fluid 18 is introduced to the fragmented mass 34 containing non-metamorphosed particles for heating at least a portion of the non-metamorphosed particles to a sufficiently high temperature for forming water-insoluble metamorphic minerals at at least the surface of such particles.

Table I presents some of the thermal metamorphic minerals which can be produced in oil shale by the introduction of a heating fluid. For example, it is believed that calcium oxide, calcium hydroxide, magnesium oxide, and magnesium hydroxide can be thermally metamorphosed to tremolite, forsterite, augite, diopside, and melilites.

Table I

| | Metamorphic Minerals |
|---|---|
| Melilite Group | $\frac{1}{2}[Ca_2Al_2SiO_7] + \frac{1}{2}[Ca_2MgSi_2O_7]$ |
| Akermanite | $Ca_2MgSi_2O_7$ |
| Gehlenite | $Ca_2Al_2SiO_7$ |
| Melilite | $Ca_2(Mg,Al)(Si_2Al)_2O_7$ |
| Augite | $Ca(Mg,Fe,Al)(Si,Al)_2O_6$ |
| Wollastonite | $CaSiO_3$ |
| Pseudowollastonite | (B-$CaSiO_3$) |
| Forsterite | $Mg_2SiO_4$ |
| Tremolite | $Ca_2Mg_5Si_8O_{22}(OH)_2$ |
| Analcite | $NaAlSi_2O_6\ H_2O$ |

Table I-continued

| | Metamorphic Minerals |
|---|---|
| Albite | $NaAlSi_3O_8$ |
| Anorthite | $CaAl_2SiU_2O_8$ |
| Mica | $K_2Al_4(Si_6Al)O_{20}(O_H)_4$ |
| Monticellite | $CaMgSiO_4$ |
| Diopside | $CaMg(SiO_3)_2$ |

Much laboratory and field work has been done on the progressive metamorphism of oil shale, notably by N. L. Bowen, "Progressive Metamorphism of Siliceous Limestone and Dolomite", *Journal of Geology,* Vol. 48, May 1940, pp 225–274; and Fyfe, Turner, and Verhoogen, "Metamorphic Reactions and Metamorphic Facies", *G.S.A. Memoir* 73, October 1958.

It has been found that thermally metamorphic minerals, including alkaline earth metal silicates, such as forsterite, tremolite, and wollastonite, form when oil shale is heated to a temperature of from about 700° to 800° F., and augite begins to form at about 900° F. When the non-metamorphosed particles are heated to a temperature of about 1900° F., the melilites begin to form, and at about 2160° F., wollastonite is thermally metamorphosed to pseudowollastonite.

It has been determined from laboratory studies that leaching of water-soluble constituents from oil increases with an increase in combustion zone temperature up to about 1400° F., and decreases with an increase in combustion zone temperature when the combustion zone temperature is above about 1400° F. In other words, leaching of water-soluble constituents from oil shale combusted under laboratory conditions is at a maximum when the combustion occurs at about 1400° F. Therefore, at least a portion of the non-metamorphosed particles are heated to a temperature of at least about 1400° F. to inhibit leaching of water-soluble constituents from the particles. Preferably, the particles are heated to at least about 1650° F. to ensure thermal metamorphosis of a substantial portion of the water-soluble constituents of the oil shale.

The upper limit on the temperature to which the non-metamorphosed particles can be heated is the temperature at which so much fusion of the oil shale occurs that introduction of a heating fluid to the fragmented mass is prevented. Fusion is undesirable, because it represents wasted energy and can plug the retort. This can occur at about 2100° F.

It is believed that leaching from oil shale in the retort 8 is inhibited in at least two ways by heating non-metamorphosed particles in the fragmented mass to a temperature at which water-insoluble metamorphic minerals are formed. First, carbonates and oxides of alkaline earth metals, which are converted to alkaline earth metal silicates, are themselves insolubilized, because the solubility of carbonates and oxides of alkaline earth metals, such as calcium carbonate and calcium oxide, is substantially greater than the solubility of corresponding silicates of the alkaline earth metals, such as augite.

The second way heating of non-metamorphosed particles in the retort 8 serves to inhibit leaching of water-soluble constituents is by forming a substantially water-insoluble barrier comprising water-insoluble metamorphic minerals at the surface of particles in the bottom portion of the fragmented mass 12. It is believed that the metamorphic minerals at the surfaces of the particles are relatively impermeable to water. These metamorphic minerals serve as a barrier that inhibits water from reaching water-soluble constituents, including water-soluble compounds of sodium, potassium, calcium, and magnesium present in the core portion of oil shale particles in the fragmented mass.

Not only is the zone 34 containing non-metamorphosed particles heated by introduction of heating fluid 18, but other portions of the fragmented mass can be heated by introduction of heating fluid. Thus, oil shale in the remainder of the fragmented mass, which, during the retorting process, was not heated to a sufficiently high temperature to form water-insoluble minerals, can be thermally metamorphosed by introduction of the heating fluid 18 to the fragmented mass.

The heating fluid can be an oxygen-containing gas, or can be a fluid substantially free of free oxygen. Preferably, the heating fluid contains oxygen for reaction with residual carbonaceous material in uncombusted oil shale in the retort. Reaction of oxygen of the heating fluid with residual carbonaceous material in uncombusted oil shale provides at least a portion of the heat required for thermally metamorphosing constituents of the fragmented mass.

The heating fluid can be at ambient temperature or can be heated to an elevated temperature, so the sensible heat of the heating fluid can provide at least a portion of the heat required for thermal metamorphosis of water-soluble constituents of the fragmented mass.

The heating fluid can contain fuel, and at least sufficient oxygen for oxidizing the fuel. Exothermic oxidation of the fuel by the oxygen can provide a portion of the heat required for thermally metamorphosing constituents of the fragmented mass. The fuel can be a gaseous fuel, such as post-retorting gas from an in situ oil shale retort; off gas from an active in situ oil shale retort, if the off gas is of sufficiently high heating value; butane, propane, natural gas, liquefied petroleum gas, or the like; a liquid fuel, such as shale oil, crude petroleum oil, diesel fuel, alcohol, or the like; a comminuted solid fuel, such as coal; and mixtures thereof. A method for generating a post-retorting gas is described in U.S. patent application Ser. No. 763,155, filed on Jan. 27, 1977, now U.S. Pat. No. 4,105,072 which is incorporated herein by this reference.

When the heating fluid is a gas, sufficient differential pressure between the top and bottom of the retort is provided to cause the heating fluid 18 to flow through the drift 14, which is in communication with the bottom of the retort, and upwardly through the retort 8. An effluent gas is withdrawn from the retort through the conduit 13, which is in communication with the upper boundary of the fragmented mass of treated oil shale particles in the retort 8. For economy, a conduit 13 used for introducing oxygen-containing gaseous feed to the retort 8 during the retorting operation is utilized to withdraw effluent gas 22 from the retort. Similarly, the drift 14 used for withdrawing off gas from the retort 8 during the retorting operation is utilized for introducing the heating fluid 18 to the retort.

Although the heating fluid can be introduced to the top of the fragmented mass, and effluent gas 22 can be withdrawn from the bottom of the fragmented mass, it is preferred to introduce the heating fluid 18 to the bottom of the fragmented mass and withdraw effluent gas from the top of the fragmented mass as shown in FIG. 1. This is because the gas produced in the zone 34 of non-metamorphosed particles by oxidation of residual carbonaceous material in uncombusted oil shale and by oxidation of the fuel in the heating fluid, if any, can be so hot that it cannot be handled by off gas processing and collection equipment. By introducing the heating fluid to the bottom portion of the fragmented mass, and withdrawing effluent gas 22 from the top of the fragmented mass, the hot gas generated in the zone of non-metamorphosed particles is cooled by cooler oil shale particles in the upper portion of the retort. Thus, the effluent gas 22 can be handled without need for special piping and collection equipment.

The heating fluid is introduced to retort 8 for sufficient time to thermally metamorphose the bulk of the water-soluble constituents of the non-metamorphosed particles to water-insoluble metamorphic minerals. To determine when sufficient heating fluid has been introduced to the retort 8, the amount of energy required for thermally metamorphosing the zone of non-metamorphosed particles can be estimated. Such an estimate can be based on knowledge of the heat capacity of the oil shale in the fragmented mass, and the location in the fragmented mass of the combustion zone when advancement of the combustion zone through the fragmented mass was stopped. a variety of techniques can be used to determine the location of the combustion zone when advancement of the combustion zone was stopped. Exemplary of such techniques are the methods described in U.S. patent application Ser. No. 796,700, filed May 13, 1977 now U.S. Pat. No. 4,151,877; U.S. patent application Ser. No. 798,076, filed May 18, 1977 now U.S. Pat. No. 4,082,145; and U.S. patent application Ser. No. 798,376, filed May 19, 1977, now abandoned. Each of these three patent applications is incorporated herein by this reference.

From the location of the farthest advancement of the combustion zone, the mass of non-metamorphosed particles can be estimated. By knowledge of the heat capacity of the oil shale, the heat required for progressively raising the zone of non-metamorphosed particles to a temperature sufficiently high that thermal metamorphosis takes place can be determined. From such a value, the amount of oxygen which needs to be consumed in the retort, either by reaction with residual carbonaceous material in uncombusted oil shale or by reaction with fuel in heating fluid, can be determined. By monitoring the amount of oxygen introduced in the heating fluid and the amount of oxygen, if any, withdrawn in the effluent gas, the oxygen consumption in the retort 8 can be determined. When sufficient oxygen has been consumed, introduction of heating fluid to the fragmented mass can be stopped.

However, it is not necessary to thermally metamorphose all of the water-soluble constituents of the non-metamorphosed particles to substantially water-insoluble metamorphic minerals. It is only necessary to form a water-insoluble barrier on the surface of the bulk of the particles. Therefore, introduction of heating fluid can be stopped before complete thermal metamorphosis has occurred.

These and other features of the present invention will be better understood with reference to the following example.

EXAMPLE

Tests were conducted to determine the effect of combustion zone temperature on the amount of water-soluble constituents in combusted oil shale, and the effect of temperature on the thermal metamorphosis of quartz, dolomite, and calcium in oil shale.

Samples of raw oil shale were obtained from the south-southwest portion of the Piceance Creek Basin of Colorado. The samples were subjected to retorting in a laboratory retort which was 6 feet in height. Ten samples were prepared, using ten separate runs. The maximum temperature at selected elevations in the retort was determined during the retorting process. The average maximum temperature was calculated by averaging the maximum temperature noted at the selected elevations. The combusted oil shale produced was pulverized to a −40 mesh size.

Samples 1, 2, 4, 5, 6, and 9 were subjected to x-ray diffraction to determine their quartz, dolomite, and calcite concentrations. The results of the x-ray diffraction are presented in FIG. 4. All of the samples were leached with deionized water for one hour, using a water-to-shale ratio of 10 milliliters of water per gram of shale. Conductivity and pH of the leachate of each sample were determined, and for samples 2, 4, and 9, the concentrations of sodium, potassium, calcium, magnesium, sulfate, carbonate, and hydroxide ion were determined. These results are presented in Table II.

TABLE II*

Equilibrium Water Quality Versus Rotorting Temperature

| Sample No. | Average Maximum Retorting Temp., ° F. | Temperature Range, ° F. | Conductivity (umho/an) | pH# | $Na^+$ | $K^+$ | $Ca^{++}$ | $Mg^{++}$ | $SO_4^=$ | $CO_3^=$ | $OH^-$ |
|---|---|---|---|---|---|---|---|---|---|---|---|
| 1 | 1041 | 1115–1021 | 1850 | 10.5 | | | | | | | |
| 2 | 1130 | 1140–1040 | 2270 | 11.0 | 49.5 | 7.25 | 375 | .25 | 648 | 36 | 73 |
| 3 | 1177 | 1210–1165 | 2000 | 11.0 | | | | | | | |
| 4 | 1276 | 1340–1020 | 3100 | 11.5 | 45 | 19.5 | 313 | .25 | 235 | 56 | 182 |
| 5 | 1329 | 1360–1220 | 4800 | 11.8 | | | | | | | |
| 6 | 1397 | 1480–1310 | 6200 | 12.1 | | | | | | | |
| 7 | 1409 | 1465–1265 | 5900 | 11.8 | | | | | | | |
| 8 | 1422 | 1495–1240 | 5400 | 11.8 | | | | | | | |
| 9 | 1433 | 1710–1250 | 5170 | 11.8 | 109 | 42.8 | 413 | .25 | 168 | 65 | 353 |
| 10 | 1555 | 1650–1200 | 3900 | 11.5 | | | | | | | |

*All quantities are in the unit of ppm, except pH and conductivity.
#The precision of pH measurement is ±0.3 unit.

Figure 2:
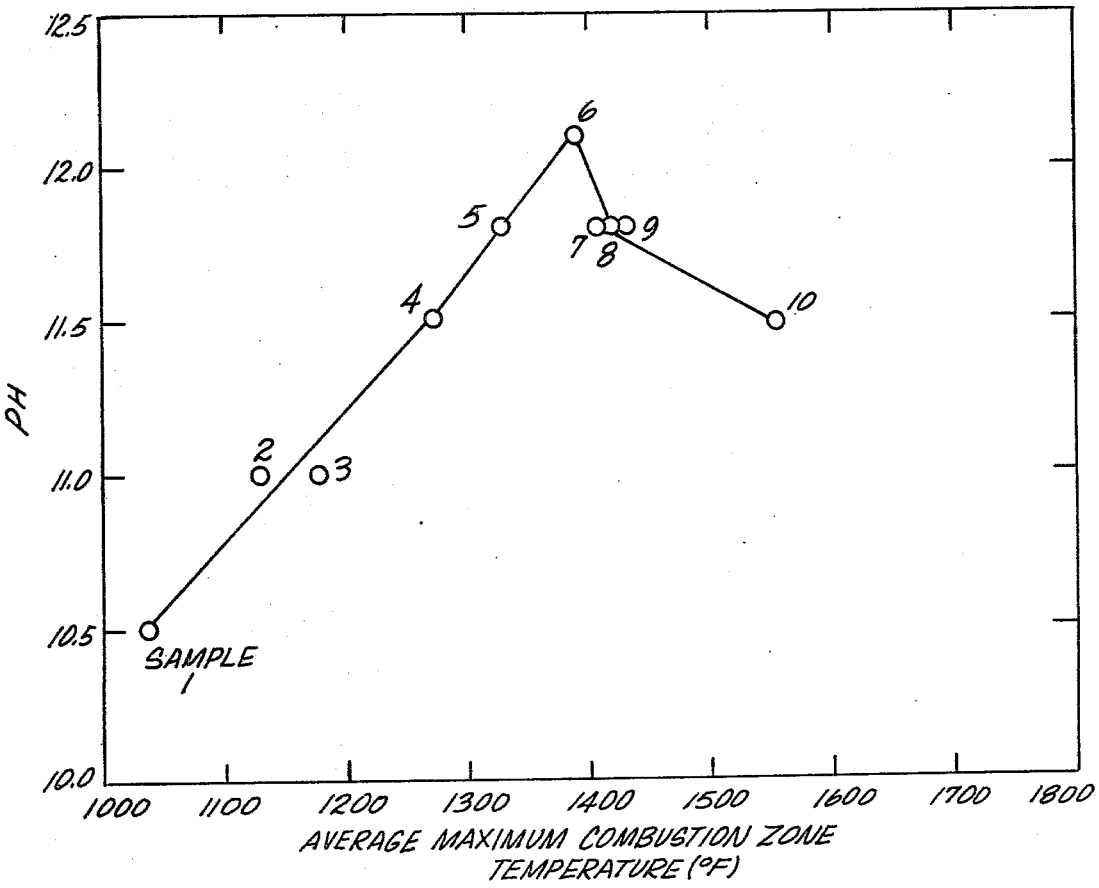
FIG. 2 is a plot of the pH of leachate formed by leaching combusted oil shale with water versus average maximum combustion zone temperature.
Figure 3:
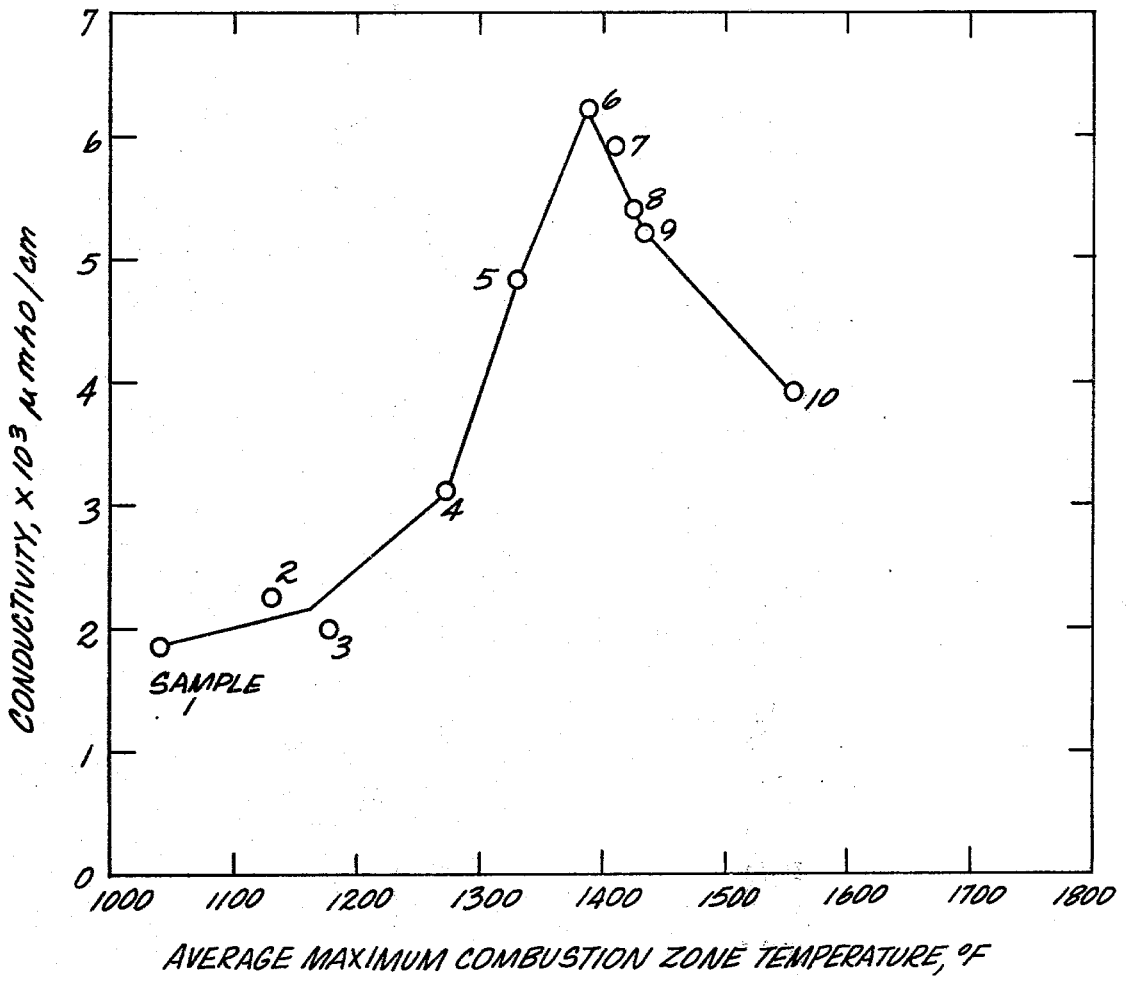
FIG. 3 is a plot of the conductivity of the leachate of FIG. 2 versus average maximum combustion zone temperature.

FIG. 2 is a plot of a pH of the leachate versus average maximum retorting temperature. As shown in FIG. 2, pH of the leachate increased with an increase of average maximum retort combustion zone temperature as the average maximum combustion zone temperature approached 1400° F. Above 1400° F., the pH of leachate decreased as the average maximum combustion zone temperature decreased. The same trend is found in FIG. 3, which shows conductivity of the leachate versus average maximum combustion zone temperature. FIG. 3 shows the equilibrium conductivity was at a maximum when average maximum combustion zone temperature was about 1400° F., equilibrium conductivity increased with an increase of the average maximum combustion zone temperature when the temperature was below 1400° F., and equilibrium conductivity decreased with an increase of average maximum combustion zone temperature when the temperature was above 1400° F.

Figure 4:
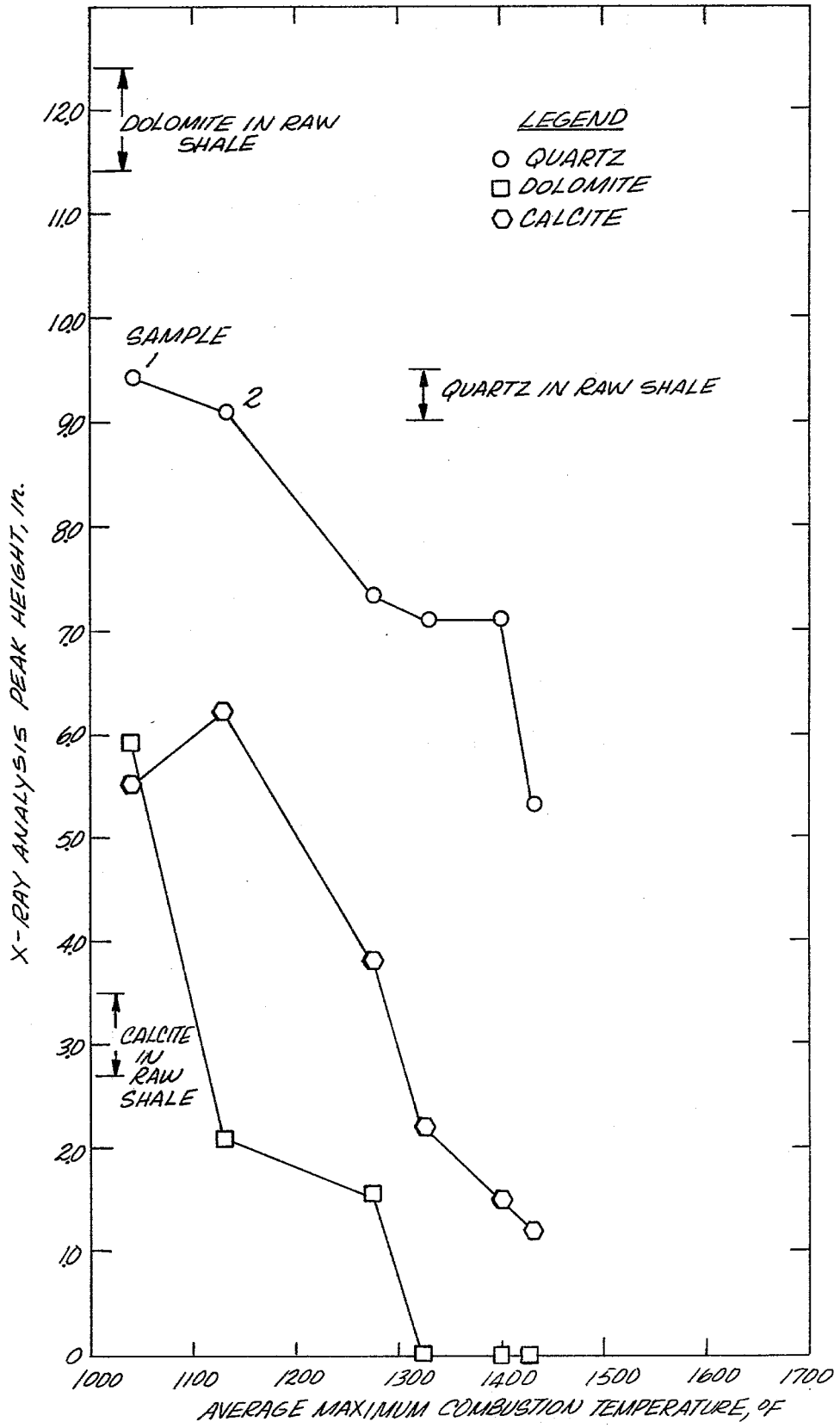
FIG. 4 shows the amount of quartz, dolomite, and calcite in combusted oil shale as a function of combustion zone temperature.

The decrease in both conductivity and pH indicate that heating combusted oil shale in accordance with principles of this invention to a temperature greater than about 1400° F. thermally metamorphoses water-soluble constituents of the oil shale to water-insoluble constituents. FIG. 4, which shows the x-ray analyses of the combusted oil shale samples versus average maximum combustion zone temperature, indicates that quartz, dolomite, and calcite are thermally changed during the combustion process, and more change occurs as the temperature increases.

It is believed that an increase in the concentration of water-soluble constituents in combusted oil shale as the average maximum temperature approaches 1400° F. is due to decomposition of calcium carbonate in oil shale to calcium oxide. Evidence of such decomposition is provided by FIG. 4. Calcium hydroxide, which is formed by hydration of calcium oxide, has a higher water-solubility than calcium carbonate.

The method of this invention provides a simple and effective process for inhibiting leaching of water-soluble constituents from treated oil shale. It is an inexpensive method, because it utilizes materials which are readily available at a retort site, namely air and a fuel, such as shale oil. Furthermore, the method also utilizes piping already installed for operation of the retort. Therefore, special raw materials and special piping are not required. All this contributes to the simplicity and effectiveness of the operation.

Although this invention has been described in considerable detail with reference to certain versions thereof, other versions are possible. For example, although the invention has been described in terms of an in situ oil shale retort containing both a combustion zone and a retorting zone, it is possible to practice this invention with a retort containing only a combustion zone or only a retorting zone. Also, although the invention has been described in terms of a retort where the combustion zone and the retorting zone are advancing downwardly through the retort, this invention is also useful for retorts where the combustion zone and the retorting zone are advancing upwardly or transverse to the vertical. Therefore, the spirit and scope of the appended claims should not necessarily be limited to the description of the versions contained herein.

What is claimed is:

1. A method for recovering shale oil from an in situ oil shale retort in a subterranean formation containing oil shale, the in situ oil shale retort containing a fragmented permeable mass of formation particles containing oil shale and including compounds containing alkaline earth metals and compounds containing silica, the method comprising the steps of:

establishing a combustion zone having a temperature of at least 1400° F. in an upper portion of the fragmented mass;

advancing the combustion zone downwardly through the fragmented mass by introducing a combustion zone feed comprising oxygen to the fragmented mass on the trailing side of the combustion zone for retorting oil shale to produce shale oil and gaseous products in a retorting zone on the advancing side of the combustion zone, thereby forming water-insoluble metamorphic minerals by thermally metamorphosing particles containing oil shale;

withdrawing shale oil and gaseous products through a fluid flow path from the fragmented mass on the advancing side of the combustion zone;

stopping introduction of combustion zone feed to the fragmented mass before the combustion zone reaches the bottom of the fragmented mass for stopping downward advancement of the combustion zone, thereby leaving fragmented mass containing non-metamorphosed particles in a bottom portion of the fragmented mass; and inhibiting leaching of alkaline earth metals from uncombusted oil shale in the bottom portion of the fragmented permeable mass by introducing sufficient heating fluid at substantially atmospheric pressure through the fluid flow path to the bottom portion of the fragmented mass for heating at least a portion of such non-metamorphosed particles to a temperature of at least about 1400° F. and less than the fusion temperature of such particles for forming water-insoluble metamorphic minerals comprising alkaline earth metal silicates at at least the surfaces of such particles at substantially atmospheric pressure.

2. The method of claim 1 in which the heating fluid comprises oxygen.

3. The method of claim 2 in which the heating fluid comprises shale oil and at least sufficient oxygen to oxidize the shale oil.

4. The method of claim 2 in which the heating fluid comprises a gaseous fuel and at least sufficient oxygen for oxidizing the gaseous fuel.

5. The method of claim 1 in which at least a portion of such non-metamorphosed particles are heated to a temperature of at least about 1650° F.

6. The method of claim 1 in which the heating fluid is introduced to the bottom portion of the fragmented mass and including the step of withdrawing an effluent gas from an upper portion of the fragmented mass.

7. A method for recovering liquid and gaseous values from a fragmented permeable mass of particles containing oil shale in an in situ oil shale retort comprising the steps of:

establishing a processing zone having a temperature greater than 1400° F. in the fragmented permeable mass;

advancing the processing zone only part way through the fragmented mass by introducing a retort inlet mixture through a first fluid flow path to the fragmented mass on the trailing side of the processing zone and withdrawing off gas through a second fluid flow path from the fragmented mass on the advancing side of the processing zone, thereby forming water-insoluble metamorphic minerals by thermally metamorphosing particles containing oil shale;

thereafter stopping introduction of the retort inlet mixture to the fragmented mass, thereby leaving at least a portion of the fragmented mass containing non-metamorphosed particles on the advancing side of the processing zone; and subsequently introducing sufficient heating fluid through such a fluid flow path to the fragmented mass containing non-metamorphosed particles while withdrawing effluent gas from the fragmented mass through the other such flow path for heating at least a portion of such non-metamorphosed particles to a sufficiently high temperature for forming water-insoluble metamorphic minerals at at least the surfaces of such particles.

8. The method of claim 7 in which at least a portion of such non-metamorphosed particles is heated to a temperature of at least about 1650° F.

9. The method of claim 7 in which at least a portion of such non-metamorphosed particles is heated to a temperature at which melilites form.

10. The method of claim 7 in which the heating fluid comprises an oxygen-containing gas.

11. In a method for recovering shale oil from an in situ oil shale retort in a subterranean formation containing oil shale, the retort containing a fragmented permeable mass of formation particles containing oil shale and having first and second end boundaries, the method comprising the steps of introducing a retort inlet mixture to the first end boundary of the fragmented mass and withdrawing off gas from the second end boundary for advancing a processing zone through a portion of the fragmented mass toward the second end boundary, thereby forming water-insoluble metamorphic minerals by thermally metamorphosing particles containing oil shale, and permanently stopping introduction of the retort inlet mixture to the fragmented mass before the processing zone reaches the second end boundary, thereby leaving at least a portion of the fragmented mass containing non-metamorphosed particles between the advancing side of the processing zone and the second end boundary, the improvement comprising the step of:

subsequent to permanently stopping introduction of the retort inlet mixture, introducing an oxygen-containing gas to the second end boundary of such fragmented mass containing non-metamorphosed particles and withdrawing effluent gas from the first end boundary for maintaining such non-metamorphosed particles at a sufficiently high temperature for a sufficiently long time for thermally metamorphosing at least the surfaces of such non-metamorphosed particles to avoid leaching of water-soluble minerals from such non-metamorphosed particles.

12. The method of claim 11 in which the step of maintaining such non-metamorphosed particles at a sufficiently high temperature comprises maintaining such non-metamorphosed particles at at least 1400° F.

13. The method of claim 11 in which such non-metamorphosed particles undergo thermal metamorphosis at substantially atmospheric pressure.

14. In a method for recovering shale oil from an in situ oil shale retort in a subterranean formation containing oil shale, the retort containing a fragmented permeable mass of formation particles containing oil shale, the method comprising the steps of introducing a retort inlet mixture to the fragmented mass for advancing a processing zone downwardly through a portion of the fragmented mass, thereby forming water-insoluble metamorphic minerals by thermally metamorphosing particles containing oil shale, and permanently stopping introduction of the retort inlet mixture to the fragmented mass, thereby leaving at least a portion of the Samples of raw oil shale were obtained from the south-southwest portion of the Piceance Creek Basin of Colorado. The samples were subjected to retorting in a laboratory retort which was 6 feet in height. Ten samples were prepared, using ten separate runs. The maximum temperature at selected elevations in the retort was determined during the retorting process. The average maximum temperature was calculated by averaging the maximum temperature noted at the selected elevations. The combusted oil shale produced was pulverized to a −40 mesh size.

Samples 1, 2, 4, 5, 6, and 9 were subjected to x-ray diffraction to determine their quartz, dolomite, and calcite concentrations. The results of the x-ray diffraction are presented in FIG. 4. All of the samples were leached with deionized water for one hour, using a water-to-shale ratio of 10 milliliters of water per gram of shale. Conductivity and pH of the leachate of each sample were determined, and for samples 2, 4, and 9, the concentrations of sodium, potassium, calcium, magnesium, sulfate, carbonate, and hydroxide ion were determined. These results are presented in Table II.

TABLE II*

Equilibrium Water Quality Versus Rotorting Temperature

| Sample No. | Average Maximum Retorting Temp., ° F. | Temperature Range, ° F. | Conductivity (umho/an) | pH# | $Na^+$ | $K^+$ | $Ca^{++}$ | $Mg^{++}$ | $SO_4^=$ | $CO_3^=$ | $OH^-$ |
|---|---|---|---|---|---|---|---|---|---|---|---|
| 1 | 1041 | 1115–1021 | 1850 | 10.5 | | | | | | | |
| 2 | 1130 | 1140–1040 | 2270 | 11.0 | 49.5 | 7.25 | 375 | .25 | 648 | 36 | 73 |
| 3 | 1177 | 1210–1165 | 2000 | 11.0 | | | | | | | |
| 4 | 1276 | 1340–1020 | 3100 | 11.5 | 45 | 19.5 | 313 | .25 | 235 | 56 | 182 |
| 5 | 1329 | 1360–1220 | 4800 | 11.8 | | | | | | | |
| 6 | 1397 | 1480–1310 | 6200 | 12.1 | | | | | | | |
| 7 | 1409 | 1465–1265 | 5900 | 11.8 | | | | | | | |
| 8 | 1422 | 1495–1240 | 5400 | 11.8 | | | | | | | |
| 9 | 1433 | 1710–1250 | 5170 | 11.8 | 109 | 42.8 | 413 | .25 | 168 | 65 | 353 |
| 10 | 1555 | 1650–1200 | 3900 | 11.5 | | | | | | | |

*All quantities are in the unit of ppm, except pH and conductivity.
#The precision of pH measurement is ±0.3 unit.

FIG. 2 is a plot of a pH of the leachate versus average maximum retorting temperature. As shown in FIG. 2, pH of the leachate increased with an increase of average maximum retort combustion zone temperature as the average maximum combustion zone temperature approached 1400° F. Above 1400° F., the pH of leachate decreased as the average maximum combustion zone temperature decreased. The same trend is found in FIG. 3, which shows conductivity of the leachate versus average maximum combustion zone temperature. FIG. 3 shows the equilibrium conductivity was at a maximum when average maximum combustion zone temperature was about 1400° F., equilibrium conductivity increased with an increase of the average maximum combustion zone temperature when the temperature was below 1400° F., and equilibrium conductivity decreased with an increase of average maximum combustion zone temperature when the temperature was above 1400° F.

The decrease in both conductivity and pH indicate that heating combusted oil shale in accordance with principles of this invention to a temperature greater than about 1400° F. thermally metamorphoses water-soluble constituents of the oil shale to water-insoluble constituents. FIG. 4, which shows the x-ray analyses of the combusted oil shale samples versus average maximum combustion zone temperature, indicates that quartz, dolomite, and calcite are thermally changed during the combustion process, and more change occurs as the temperature increases.

It is believed that an increase in the concentration of water-soluble constituents in combusted oil shale as the average maximum temperature approaches 1400° F. is due to decomposition of calcium carbonate in oil shale to calcium oxide. Evidence of such decomposition is provided by FIG. 4. Calcium hydroxide, which is formed by hydration of calcium oxide, has a higher water-solubility than calcium carbonate.

The method of this invention provides a simple and effective process for inhibiting leaching of water-soluble constituents from treated oil shale. It is an inexpensive method, because it utilizes materials which are readily available at a retort site, namely air and a fuel, such as shale oil. Furthermore, the method also utilizes piping already installed for operation of the retort. Therefore, special raw materials and special piping are not required. All this contributes to the simplicity and effectiveness of the operation.

Although this invention has been described in considerable detail with reference to certain versions thereof, other versions are possible. For example, although the invention has been described in terms of an in situ oil shale retort containing both a combustion zone and a retorting zone, it is possible to practice this invention with a retort containing only a combustion zone or only a retorting zone. Also, although the invention has been described in terms of a retort where the combustion zone and the retorting zone are advancing downwardly through the retort, this invention is also useful for retorts where the combustion zone and the retorting zone are advancing upwardly or transverse to the vertical. Therefore, the spirit and scope of the appended claims should not necessarily be limited to the description of the versions contained herein.

What is claimed is:

1. A method for recovering shale oil from an in situ oil shale retort in a subterranean formation containing oil shale, the in situ oil shale retort containing a fragmented permeable mass of formation particles containing oil shale and including compounds containing alkaline earth metals and compounds containing silica, the method comprising the steps of:

establishing a combustion zone having a temperature of at least 1400° F. in an upper portion of the fragmented mass;

advancing the combustion zone downwardly through the fragmented mass by introducing a combustion zone feed comprising oxygen to the fragmented mass on the trailing side of the combustion zone for retorting oil shale to produce shale oil and gaseous products in a retorting zone on the advancing side of the combustion zone, thereby forming water-insoluble metamorphic minerals by thermally metamorphosing particles containing oil shale;

withdrawing shale oil and gaseous products through a fluid flow path from the fragmented mass on the advancing side of the combustion zone;

stopping introduction of combustion zone feed to the fragmented mass before the combustion zone reaches the bottom of the fragmented mass for stopping downward advancement of the combustion zone, thereby leaving fragmented mass containing non-metamorphosed particles in a bottom portion of the fragmented mass; and inhibiting leaching of alkaline earth metals from uncombusted oil shale in the bottom portion of the fragmented permeable mass by introducing sufficient heating fluid at substantially atmospheric pressure through the fluid flow path to the bottom portion of the fragmented mass for heating at least a portion of such non-metamorphosed particles to a temperature of at least about 1400° F. and less than the fusion temperature of such particles for forming water-insoluble metamorphic minerals comprising alkaline earth metal silicates at at least the surfaces of such particles at substantially atmospheric pressure.

2. The method of claim 1 in which the heating fluid comprises oxygen.

3. The method of claim 2 in which the heating fluid comprises shale oil and at least sufficient oxygen to oxidize the shale oil.

4. The method of claim 2 in which the heating fluid comprises a gaseous fuel and at least sufficient oxygen for oxidizing the gaseous fuel.

5. The method of claim 1 in which at least a portion of such non-metamorphosed particles are heated to a temperature of at least about 1650° F.

6. The method of claim 1 in which the heating fluid is introduced to the bottom portion of the fragmented mass and including the step of withdrawing an effluent gas from an upper portion of the fragmented mass.

7. A method for recovering liquid and gaseous values from a fragmented permeable mass of particles containing oil shale in an in situ oil shale retort comprising the steps of:

establishing a processing zone having a temperature greater than 1400° F. in the fragmented permeable mass;

advancing the processing zone only part way through the fragmented mass by introducing a retort inlet mixture through a first fluid flow path to the fragmented mass on the trailing side of the processing zone and withdrawing off gas through a second fluid flow path from the fragmented mass on the advancing side of the processing zone, thereby forming water-insoluble metamorphic minerals by thermally metamorphosing particles containing oil shale;

thereafter stopping introduction of the retort inlet mixture to the fragmented mass, thereby leaving at least a portion of the fragmented mass containing non-metamorphosed particles on the advancing side of the processing zone; and subsequently introducing sufficient heating fluid through such a fluid flow path to the fragmented mass containing non-metamorphosed particles while withdrawing effluent gas from the fragmented mass through the other such flow path for heating at least a portion of such non-metamorphosed particles to a sufficiently high temperature for forming water-insoluble metamorphic minerals at at least the surfaces of such particles.

8. The method of claim 7 in which at least a portion of such non-metamorphosed particles is heated to a temperature of at least about 1650° F.

9. The method of claim 7 in which at least a portion of such non-metamorphosed particles is heated to a temperature at which melilites form.

10. The method of claim 7 in which the heating fluid comprises an oxygen-containing gas.

11. In a method for recovering shale oil from an in situ oil shale retort in a subterranean formation containing oil shale, the retort containing a fragmented permeable mass of formation particles containing oil shale and having first and second end boundaries, the method comprising the steps of introducing a retort inlet mixture to the first end boundary of the fragmented mass and withdrawing off gas from the second end boundary for advancing a processing zone through a portion of the fragmented mass toward the second end boundary, thereby forming water-insoluble metamorphic minerals by thermally metamorphosing particles containing oil shale, and permanently stopping introduction of the retort inlet mixture to the fragmented mass before the processing zone reaches the second end boundary, thereby leaving at least a portion of the fragmented mass containing non-metamorphosed particles between the advancing side of the processing zone and the second end boundary, the improvement comprising the step of:

subsequent to permanently stopping introduction of the retort inlet mixture, introducing an oxygen-containing gas to the second end boundary of such fragmented mass containing non-metamorphosed particles and withdrawing effluent gas from the first end boundary for maintaining such non-metamorphosed particles at a sufficiently high temperature for a sufficiently long time for thermally metamorphosing at least the surfaces of such non-metamorphosed particles to avoid leaching of water-soluble minerals from such non-metamorphosed particles.

12. The method of claim 11 in which the step of maintaining such non-metamorphosed particles at a sufficiently high temperature comprises maintaining such non-metamorphosed particles at at least 1400° F.

13. The method of claim 11 in which such non-metamorphosed particles undergo thermal metamorphosis at substantially atmospheric pressure.

14. In a method for recovering shale oil from an in situ oil shale retort in a subterranean formation containing oil shale, the retort containing a fragmented permeable mass of formation particles containing oil shale, the method comprising the steps of introducing a retort inlet mixture to the fragmented mass for advancing a processing zone downwardly through a portion of the fragmented mass, thereby forming water-insoluble metamorphic minerals by thermally metamorphosing particles containing oil shale, and permanently stopping introduction of the retort inlet mixture to the fragmented mass, thereby leaving at least a portion of the fragmented mass containing non-metamorphosed particles at the bottom of the fragmented mass the improvement comprising the step of:

subsequent to permanently stopping introduction of the retort inlet mixture, maintaining such non-metamorphosed particles at a sufficiently high temperature by introducing an oxygen-containing gas to the bottom of the fragmented mass containing non-metamorphosed particles for a sufficiently long time for thermally metamorphosing at least the surfaces of such non-metamorphosed particles to avoid leaching of water-soluble minerals from such non:metamorphosed particles.

15. In a method for recovering shale oil from an in situ oil shale retort in a subterranean formation containing oil shale, the retort containing a fragmented permeable mass of formation particles containing oil shale, the method comprising the steps of introducing a retort inlet mixture to the fragmented mass for advancing a processing zone through a portion of the fragmented mass, thereby forming water-insoluble metamorphic minerals by thermally metamorphosing particles containing oil shale, and permanently stopping introduction of the retort inlet mixture to the fragmented mass, thereby leaving at least a portion of the fragmented mass containing non-metamorphosed particles on the advancing side of the processing zone, the improvement comprising the step of:

subsequent to permanently stopping introduction of the retort inlet mixture, introducing an oxygen-containing gas to the bottom of the fragmented mass containing non-metamorphosed particles for maintaining such non-metamorphosed particles at a sufficiently high temperature for a sufficiently long time for thermally metamorphosing at least the surfaces of such non-metamorphosed particles to avoid leaching of water-soluble minerals from such non-metamorphosed particles and withdrawing an effluent gas from an upper portion of the fragmented mass.

16. A method for recovering liquid and gaseous hydrocarbons from an in situ oil shale retort in a subterranean formation containing oil shale, the retort containing a fragmented permeable mass of formation particles containing oil shale and having opposed first and second end boundaries, the method comprising the steps of:

establishing a combustion zone having a temperature of at least 1400° F. in the fragmented permeable mass at the first end boundary of the retort;

advancing the combustion zone through the fragmented mass toward the second end boundary by introducing a combustion zone feed comprising oxygen to the fragmented mass on the trailing side of the combustion zone, whereby combustion gas and shale oil and water-soluble metamorphic minerals are formed in the combustion zone;

withdrawing off gas comprising combustion gas and any gaseous unreacted portion of the combustion feed from the fragmented mass at the second end boundary;

stopping introduction of the combustion zone feed to the fragmented mass, thereby leaving a zone of non-metamorphosed particles in the fragmented mass on the advancing side of the combustion zone; and subsequently introducing at the second end boundary to such fragmented mass containing non-metamorphosed particles an oxygen-containing gas for heating at least a portion of such fragmented mass to a sufficiently high temperature for forming water-insoluble metamorphic minerals while withdrawing effluent gas from the fragmented mass at the first end boundary.

17. The method of claim 16 in which at least a portion of such fragmented mass containing non-metamorphosed particles is heated to a temperature of at least about 1400° F.

18. The method of claim 16 in which at least a portion of such fragmented mass containing non-metamorphosed particles is heated to a temperature of at least about 1650° F.

19. The method of claim 16 in which at least a portion of such fragmented mass containing non-metamorphosed particles is heated to a temperature at which melilites form.

20. The method of claim 16 in which at least a portion of such fragmented mass containing non-metamorphosed particles is heated to a temperature at which wollastonite forms.

21. The method of claim 16 in which the first end boundary is at the top of the fragmented mass, and the second end boundary is at the bottom of the fragmented mass.

22. The method of claim 21 in which the oxygen-containing gas is introduced at the bottom of the fragmented mass, and effluent gas is withdrawn from an upper portion of the fragmented mass.

23. A method for recovering shale oil from an in situ oil shale retort in a subterranean formation containing oil shale, the in situ oil shale retort containing a fragmented permeable mass of formation particles containing oil shale, comprising the steps of:

establishing a combustion zone having a temperature of at least 1400° F. in the fragmented mass;

advancing the combustion zone downwardly through the fragmented mass by introducing an oxygen-containing combustion zone feed to the fragmented mass on the trailing side of the combustion zone for forming water-insoluble metamorphic minerals by thermally metamorphosing particles containing oil shale in the combustion zone and for retorting oil shale in a retorting zone on the advancing side of the combustion zone for forming shale oil and retorted oil shale containing residual carbonaceous material;

stopping introduction of the combustion zone feed for stopping downward advancement of the combustion zone through the fragmented mass after the retorting zone reaches the bottom of the fragmented mass and before the combustion zone reaches the bottom of the fragmented mass, thereby leaving fragmented mass containing non-metamorphosed particles at the bottom of the fragmented mass; and subsequently inhibiting leaching by water of water-soluble constituents of non-metamorphosed particles at the bottom of the fragmented mass by introducing an oxygen-containing gas to the fragmented mass at the bottom of the retort for oxidizing residual carbonaceous material in retorted oil shale in the fragmented mass for thermally metamorphosing at a temperature of at least 1400° F. at least a portion of such water-soluble constituents of non-metamorphosed particles to water-insoluble metamorphic minerals.

24. The method of claim 23 in which leaching is inhibited by metamorphosing calcium oxide to tremolite.

25. The method of claim 24 in which leaching is inhibited by metamorphosing calcium hydroxide to tremolite.

26. The method of claim 23 in which leaching is inhibited by metamorphosing magnesium oxide to tremolite.

27. The method of claim 23 in which leaching is inhibited by metamorphosing magnesium hydroxide to tremolite.

28. The method of claim 23 in which leaching is inhibited by metamorphosing magnesium oxide to forsterite.

29. The method of claim 23 in which leaching is inhibited by metamorphosing magnesium hydroxide to forsterite.

30. The method of claim 23 in which leaching is inhibited by metamorphosing calcium oxide to augite.

31. The method of claim 23 in which leaching is inhibited by metamorphosing calcium hydroxide to augite.

32. The method of claim 23 in which leaching is inhibited by metamorphosing magnesium oxide to augite.

33. The method of claim 23 in which leaching is inhibited by metamorphosing magnesium hydroxide to augite.

* * * * *

UNITED STATES PATENT AND TRADEMARK OFFICE

CERTIFICATE OF CORRECTION

PATENT NO. : 4,202,412

DATED : May 13, 1980

INVENTOR(S) : Arnold M. Ruskin

It is certified that error appears in the above-identified patent and that said Letters Patent are hereby corrected as shown below:

Column 8, line 23, "a" should be -- A --.

Column 11, lines 30, 31, "at substantially atmospheric pressure" should be deleted.

Signed and Sealed this

*Twenty-second* Day of *July 1980*

[SEAL]

*Attest:*

SIDNEY A. DIAMOND

*Attesting Officer*

*Commissioner of Patents and Trademarks*